US008611554B2

(12) United States Patent
Short et al.

(10) Patent No.: US 8,611,554 B2
(45) Date of Patent: Dec. 17, 2013

(54) HEARING ASSISTANCE APPARATUS

(75) Inventors: William R. Short, Southborough, MA (US); Luke C. Walters, Miami, FL (US)

(73) Assignee: Bose Corporation, Framingham, MA (US)

( * ) Notice: Subject to any disclaimer, the term of this patent is extended or adjusted under 35 U.S.C. 154(b) by 917 days.

(21) Appl. No.: 12/107,114

(22) Filed: Apr. 22, 2008

(65) Prior Publication Data

US 2009/0262969 A1 Oct. 22, 2009

(51) Int. Cl.
*H04R 1/10* (2006.01)

(52) U.S. Cl.
USPC ..... 381/74

(58) Field of Classification Search
USPC ..... 381/74
See application file for complete search history.

(56) References Cited

U.S. PATENT DOCUMENTS

| | | | | |
|---|---|---|---|---|
| 4,066,842 | A | 1/1978 | Allen | |
| 4,455,675 | A | 6/1984 | Bose | |
| 4,485,484 | A | 11/1984 | Flanagan | |
| 4,653,102 | A | 3/1987 | Hansen | |
| 4,731,847 | A | 3/1988 | Lybrook et al. | |
| 4,904,078 | A | 2/1990 | Gorike | |
| 5,051,964 | A | 9/1991 | Sasaki | |
| 5,181,252 | A * | 1/1993 | Sapiejewski et al. | 381/372 |
| 5,197,098 | A | 3/1993 | Drapeau | |
| 5,479,522 | A | 12/1995 | Lindemann et al. | |
| 5,550,924 | A | 8/1996 | Helf et al. | |
| 5,651,071 | A | 7/1997 | Lindemann et al. | |
| 5,757,937 | A | 5/1998 | Itoh et al. | |
| 5,778,082 | A | 7/1998 | Chu et al. | |
| 5,815,582 | A * | 9/1998 | Claybaugh et al. | 381/71.6 |
| 5,901,232 | A | 5/1999 | Gibbs | |
| 6,137,887 | A | 10/2000 | Anderson | |
| 6,198,830 | B1 | 3/2001 | Holube et al. | |
| 6,222,927 | B1 | 4/2001 | Feng et al. | |
| 6,549,630 | B1 | 4/2003 | Bobisuthi | |
| 6,594,365 | B1 | 7/2003 | Eatwell | |
| 6,704,428 | B1 * | 3/2004 | Wurtz | 381/370 |

(Continued)

FOREIGN PATENT DOCUMENTS

| | | | |
|---|---|---|---|
| CN | 1261759 | A | 8/2000 |
| CN | 1998265 | A | 7/2007 |

(Continued)

OTHER PUBLICATIONS

International Report on Patentability dated Nov. 4, 2010, for PCT/US2009/037503, 7 pages.

(Continued)

*Primary Examiner* — Alexander Talpalatski
(74) *Attorney, Agent, or Firm* — Bose Corporation

(57) ABSTRACT

A hearing assistance device includes two transducers which react to a characteristic of an acoustic wave to capture data representative of the characteristic. The device is arranged so that each transducers is located adjacent a respective ear of a person wearing the device. A signal processor processes the data to provide relatively more emphasis of data representing a first sound source the person is facing over data representing a second sound source the person is not facing. At least one speaker utilizes the data to reproduce sounds to the person. An active noise reduction system provides a signal to the speaker for reducing an amount of ambient acoustic noise in the vicinity of the person that is heard by the person.

12 Claims, 15 Drawing Sheets

(56) References Cited

U.S. PATENT DOCUMENTS

| | | | | |
|---|---|---|---|---|
| 6,823,176 | B2 | 11/2004 | Rogers | |
| 6,888,945 | B2 | 5/2005 | Horrall | |
| 6,912,178 | B2 | 6/2005 | Chu et al. | |
| 6,978,159 | B2 | 12/2005 | Feng et al. | |
| 6,983,055 | B2 | 1/2006 | Luo | |
| 6,987,856 | B1 | 1/2006 | Feng et al. | |
| 7,013,015 | B2 | 3/2006 | Hohmann et al. | |
| 7,065,219 | B1 * | 6/2006 | Abe et al. | 381/74 |
| 7,346,175 | B2 * | 3/2008 | Hui et al. | 381/74 |
| 2002/0150261 | A1 | 10/2002 | Moeller et al. | |
| 2003/0002692 | A1 | 1/2003 | McKitrick et al. | |
| 2003/0091199 | A1 | 5/2003 | Horrall et al. | |
| 2003/0228023 | A1 | 12/2003 | Burnett et al. | |
| 2004/0125922 | A1 | 7/2004 | Specht | |
| 2004/0179699 | A1 | 9/2004 | Moeller et al. | |
| 2005/0232440 | A1 | 10/2005 | Roovers | |
| 2005/0249361 | A1 | 11/2005 | Beavis et al. | |
| 2005/0276419 | A1 | 12/2005 | Eggert et al. | |
| 2006/0013409 | A1 * | 1/2006 | Desloge | 381/72 |
| 2006/0050898 | A1 | 3/2006 | Yamada et al. | |
| 2006/0109983 | A1 | 5/2006 | Young et al. | |
| 2007/0050176 | A1 | 3/2007 | Taenzer et al. | |
| 2008/0013762 | A1 | 1/2008 | Roeck et al. | |
| 2008/0170718 | A1 | 7/2008 | Faller | |
| 2008/0317260 | A1 | 12/2008 | Short | |

FOREIGN PATENT DOCUMENTS

| | | | |
|---|---|---|---|
| EP | 1489596 | | 12/2004 |
| EP | 1600791 | | 11/2005 |
| GB | 806261 | A | 12/1958 |
| GB | 2394589 | | 4/2004 |
| JP | 06-233388 | | 8/1994 |
| JP | 2000-270391 | | 9/2000 |
| JP | 2002-095084 | | 3/2002 |
| JP | 2004-289762 | A | 10/2004 |
| JP | 2004334218 | A | 11/2004 |
| JP | 2006-267444 | A | 10/2006 |
| JP | 2007036608 | A | 2/2007 |
| JP | 2007-135046 | A | 5/2007 |
| JP | 2008507926 | A | 3/2008 |
| WO | 2006026812 | | 3/2006 |
| WO | 2006028587 | | 3/2006 |

OTHER PUBLICATIONS

Olson, Harry F., Directional Microphones, Journal of the Audio Engineering Society, pp. 420-430. Oct. 1967.

Shulman, Uri, Shure Brothers Inc., Reducing Off-Axis Comb Filter Effects in Highly Directional Microphones, Presented at the 81st Convention Nov. 12-16, 1986, Los Angeles, CA, 2405 (D-19), pp. 1-9.

Wittkop, Two-channel noise reduction algorithms motivated by models of binaural interaction, Sep. 9, 1968, Hamburg, Germany. Chapter 3, pp. 39-59.

B. Kollmeier, et. al. Binaural Noise-Reduction Hearing Aid Scheme with Real-Time Processing in the Frequency Domain, Scand Audiol 1993; Suppl. 38: 28-38. From the Drittes Physikalisches Institut der Unviersitat Gottingen, Burgerstr. 42-44, W-3400 Gottingen, FR Germany.

M. Nilsson, Ph.D., Sonic Innovations, Salt Lake City, Utah Topic: Sonic Innovations new product—Innova Feb. 28, 2005, http://www.audiologyonline.com/interview/displayarchives.asp?interviewid=324.

Aarabi, Phase-Based Dual-Microphone Robust Speech Enhancement, IEEE Transactions on Systems, Man, and Cybernetics—Part B: Cybernetics, vol. 34, No. 4, Aug. 2004. pp. 1763-1773.

P. Bloom, Evaluation of Two-Input Speech Dereverberation Techniques, Division of Engineering Polytechnic of Central London, London W1M 8JS, England. CH 1746-7/82/0000—0164 $00.75 © 1982 IEEE, pp. 164-167.

Baard, Frames with baked-in hearing aides, Apr. 17, 2006, http://www.boston.com/business/personaltech/articles/2006/04117/frames_with_baked_in_hearing_ai . . . , Downloaded Apr. 19, 2006.

Aarabi, Post Recognition Speech Localization, International Journal of Speech Technology 8, 173-180, 2005, Springer Science + Business Media, Inc. Manufactured in the Netherlands, pp. 173-180.

V. Hamacher, et al., Signal Processing in High-End Hearing Aids: State of the Art, Challenges, and Future Trends, EURASIP Journal on Applied Signal Processing 2005:18, 2915-2929 © 2005 V. Hamacher et al.

Mungamura, et al., Enhanced Sound Localization, IEEE Transactions on Systems, Man, and Cybernetics—Part B: Cybernetics, vol. 34, No. 3, Jun. 2004, 1083-4419/04$20.00 © 2004 IEEE, pp. 1526-1540.

Aarabi, MIT's Magazine of Innovation Technology Review, Oct. 2005, USDA, www.technology review.com, p. 42.

Wittkop, et al., Strategy-selective noise reduction for binaural digital hearing aides, NH Elsevier, Speech Communication 39 (2003) 111-138, www.elsevier.com/located/specom, Medizinische Physik, Universitat Oldenburg, D-26111, Germany, Copyright 2002.

B. Kollmeier, et al. Binaural Noise-Reduction Hearing Aid Scheme with Real-Time Processing in the Frequency Domain, Scand Audiol 1993; Suppl. 38; 28-38.

Fortschritt-BerichteVDI, Dipl. Phys. Jurgen Peissign, Gottingen, Binaurale Horgeratestrategien in komplexen Storschallsituationen, Reihe 17: Biotechnik, copyright 1993. See Concise Explanation of the Relevance of "Strategies for Binaural Hearing Aids in Complex Sound Fields".

Bai, et al., Microphone array signal processing with application in three-dimensional spatial hearing, Acoustical Society of America, pp. 2112-2121, copyright 2005.

International Search Report and Written Opinion dated Jun. 23, 2009 issued in International Application No. PCT/US2009/037503.

Canetto, B., et al: "Speech Enhancement Systems Based on Microphone Arrays", May 27, 2002-May 31, 2002, pp. 1-9, XP007905367.

International Search Report and Written Opinion dated Aug. 12, 2008 for PCT/US08/064056.

International Preliminary Report on Patentability dated Sep. 16, 2009 for PCT/US08/064056.

Japanese Office Action dated Jan. 8, 2013 for Application No. 2011-506317.

Chinese Office Action dated Jan. 24, 2013 for Application No. 200980113532.3.

Beranek, Leo L; "Acoustics", Published for the Acoustical Society of America by the American Institue of Physics; 1954, 1986.

CN Office Action dated Jan. 24, 2013 for CN Appl. 200980113532.3.

JP Office Action dated Jun. 25, 2013 for JP2012-073301.

EP Refusal Decision dated Jul. 22, 2013 for EP09733837.0.

CN Office Action dated Jul. 31, 2013 for CN Appln. No. 200980113532.3.

* cited by examiner

HEARING ASSISTANCE APPARATUS

BACKGROUND

This disclosure relates to a method and apparatus for providing a hearing assistance device which allows a sound source of interest to be heard more clearly in a noisy environment.

SUMMARY

According to a first aspect of the invention, a hearing assistance device includes two transducers which react to a characteristic of an acoustic wave to capture data representative of the characteristic. The device is arranged so that each transducers is located adjacent a respective ear of a person wearing the device. A signal processor processes the data to provide relatively more emphasis of data representing a first sound source the person is facing over data representing a second sound source the person is not facing. At least one speaker utilizes the data to reproduce sounds to the person. An active noise reduction system provides a signal to the speaker for reducing an amount of ambient acoustic noise in the vicinity of the person that is heard by the person.

The hearing assistance device can include a voice activity detector. The output of the voice activity detector can be used to alter a characteristic of the signal processor. The characteristic of the signal processor can be altered based on a likelihood that the voice activity detector has detected a human voice in the first sound source. A gain of substantially 1 can be applied to data representing the first sound source, and a gain of substantially less than 1 can be applied to data representing the second sound source.

The signal processor can be adjustable as a function of at least one of frequency, a user setting, an amount of active noise reduction, a ratio of acoustic energy from sound sources in the zone to sound sources outside the zone, and sound level in a vicinity of the transducers, in order to adjust an effective size of the zone. The signal processor can be manually or automatically adjustable in order to adjust an effective size of the zone.

According to another aspect of the invention, a hearing assistance device includes two transducers, spaced from each other, which react to a characteristic of an acoustic wave to capture data representative of the characteristic. A signal processor processes the data to determine (a) which data represents one or more sound sources located within a zone in front of the user, and (b) which data represents one or more sound sources located outside of the zone. The signal processor provides relatively less emphasis of data representing the sound source(s) outside the zone over data representing the sound source(s) inside the zone. A characteristic of the signal processor is adjusted based on whether or not a voice activity detector determines that a human voice is making sound within the zone. At least one speaker utilizes the data to reproduce sounds to the user.

The hearing assistance device can include an active noise reduction system that provides a signal to the speaker for reducing an amount of ambient acoustic noise in the vicinity of the user that is heard by the user.

According to a further aspect of the invention, a method of providing hearing assistance to a person, includes the steps of transforming data, collected by transducers which react to a characteristic of an acoustic wave, into signals for each transducer location. The signals are separated into a plurality of frequency bands for each location. For each band it is determined from the signals whether or not a sound source providing energy to a particular band is substantially facing the person. A relative gain change is caused between those frequency bands whose signal characteristics indicate that a sound source providing energy to a particular band is substantially facing the person, and those frequency bands whose signal characteristics indicate that a sound source providing energy to a particular band is not substantially facing the person. The signal processor is adjustable as a function of at least one of frequency, a user setting, an amount of active noise reduction, a ratio of acoustic energy from sound sources substantially facing the person to sound sources substantially not facing the person, and sound level in a vicinity of the transducers, in order to adjust an effective size of a zone in which a sound source is considered to be substantially facing the person.

The method can include that the separating, determining and causing steps are accomplished by a signal processor. A characteristic of the signal processor can be adjusted based on whether or not a voice activity detector determines that the person is facing a human voice.

According to another aspect of the invention, a hearing assistance device includes a voice activity detector into which a gain signal is input. The output of the voice activity detector is indicative of whether or not a voice of interest is present.

The hearing assistance device can further include a first low pass filter which receives as a first input the output of the voice activity detector. The hearing assistance device can have as a feature that the low pass filter receives as a second input the gain signal, the output of the voice activity detector setting the cutoff frequency of the low pass filter. The hearing assistance device can have the feature that when the voice activity detector indicates the presence of a voice signal, the cutoff frequency is set to a relatively higher frequency, and when the voice activity detector indicates an absence of a voice signal, the cutoff frequency is set to a relatively lower frequency. The hearing assistance device can include a variable rate fast attack slow decay (FASD) filter which receives as an input the output of the low pass filter.

The hearing assistance device can include the feature that when an average over a period of time of the input to the FASD filter is at a first level, a decay rate of the FASD filter is set to be at a first rate, and when an average over a period of time of the input to the FASD filter is at a second level above the first level, a decay rate of the FASD filter is set to be at a second rate below the first rate.

The hearing assistance device can include a second low pass filter which receives as an input the output of the FASD filter. When the input to the second low pass filter is above a threshold this input is passed through the second low pass filter unmodified. When the input to the second low pass filter is below the threshold this input is low pass filtered by the second low pass filter. The hearing assistance device can include a median filter which receives as an input the output of the second low pass filter.

In accordance with a further aspect of the invention, a hearing assistance device includes two transducers which react to a characteristic of an acoustic wave to capture data representative of the characteristic. A signal processor processes the data to (a) provide a first level of emphasis to data representing a first sound source that a user of the hearing assistance device is facing, the first sound source being substantially on axis with the user, (b) provide a second level of emphasis lower than the first level of emphasis to data representing a second sound source off axis with the user, and (c) provide a third level of emphasis lower than the second level of emphasis to data representing a third sound source that is relatively more off axis than the second sound source. At least one speaker utilizes the data to reproduce sounds to the person.

The hearing assistance device can have the feature of the signal processor providing a fourth level of emphasis lower than the third level of emphasis to data representing a fourth sound source that is relatively more off axis than the third sound source.

According to another aspect of the invention, a method of providing hearing assistance to a person includes the steps of transforming data, collected by two transducers which react to a characteristic of an acoustic wave, into signals for each transducer location. The signals are utilized to determine a magnitude relationship and a phase angle relationship between the two transducers for a plurality of frequency bands at certain points in time. The magnitude relationship and phase angle relationship for each frequency band are mapped onto a two-dimensional plot. An origin of the plot can be determined, the origin being where the magnitudes are substantially equal to each other and the phase angles are substantially equal to each other. A relative gain change is caused between those frequency bands whose mapped magnitude relationship and phase angle relationship is relatively closer to the origin of the plot compared to those frequency bands whose mapped magnitude relationship and phase angle relationship is relatively further from the origin of the plot.

According to a further aspect of the invention, an apparatus for providing hearing assistance to a person includes a pair of transducers which react to a characteristic of an acoustic wave to create signals for each transducer location. A signal processor separates the signals into a plurality of frequency bands for each location. The signal processor, for each band, establishes a relationship between the signals. The signal processor applies a gain of substantially 1 to those frequency bands whose signal relationship meets a predetermined criteria. The signal processor applies a gain of substantially less than 1 to those frequency bands whose signal relationship does not meet the predetermined criteria.

DETAILED DESCRIPTION

Figure 1:
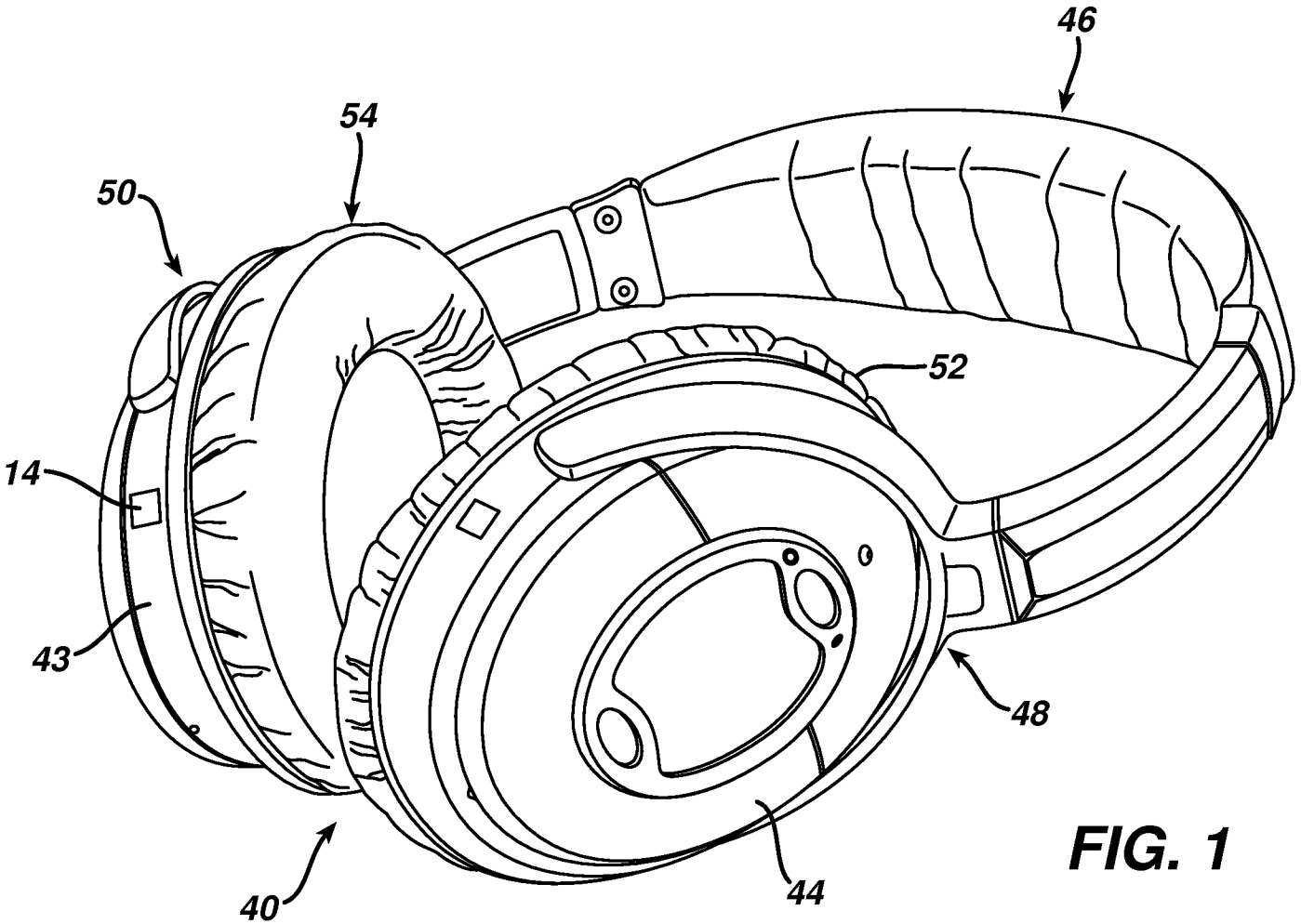
FIG. 1 is a perspective view of a hearing assistance device embodying the invention.

With reference now to the drawings, and more particularly to FIG. 1 thereof, there is shown a perspective view of a hearing assistance apparatus in the form of headphones 40 embodying the invention. The headphones 40 include earcups 43 and 44 which are intercoupled by a headband 46 with depending yoke assemblies 48 and 50. The earcups 43 and 44 include respective circumaural cushions 52 and 54 as well as respective internal acoustic drivers (not shown). The earcups provide passive noise reduction for ambient noise in the vicinity of the headphones 40. An active noise reduction (ANR) system can also be included in the headphones 40. Such an ANR system actively reduces the amount of ambient noise reaching a person's ears by creating "anti-noise" with an acoustic driver. The "anti-noise" cancels out a portion of the ambient noise. Further details of an example with an ANR system will be described later in the specification.

A pair of microphones (transducers) 12 and 14 are located on respective earcups 44 and 43. When a user is wearing the headphones 40, transducers 12 and 14 are each preferably located adjacent a respective ear of the user and preferably face in a direction that the user is facing. Transducers 12 and 14 can be located on other portions of headphones 40 as long as they are separated by a sufficient distance from each other. The transducers 12 and 14 are each preferably a directional (e.g. first order gradient) transducer (microphone), although other types of transducers (e.g. omni-directional) can be used. The transducers collect data at their respective locations by reacting to a characteristic of an acoustic wave such as local sound pressure, the first order sound pressure gradient, higher-order sound pressure gradients, or combinations thereof. The transducers each transform the instantaneous sound pressure present at their respective location into electrical signals which represent the sound pressure over time at those locations.

Figure 2:
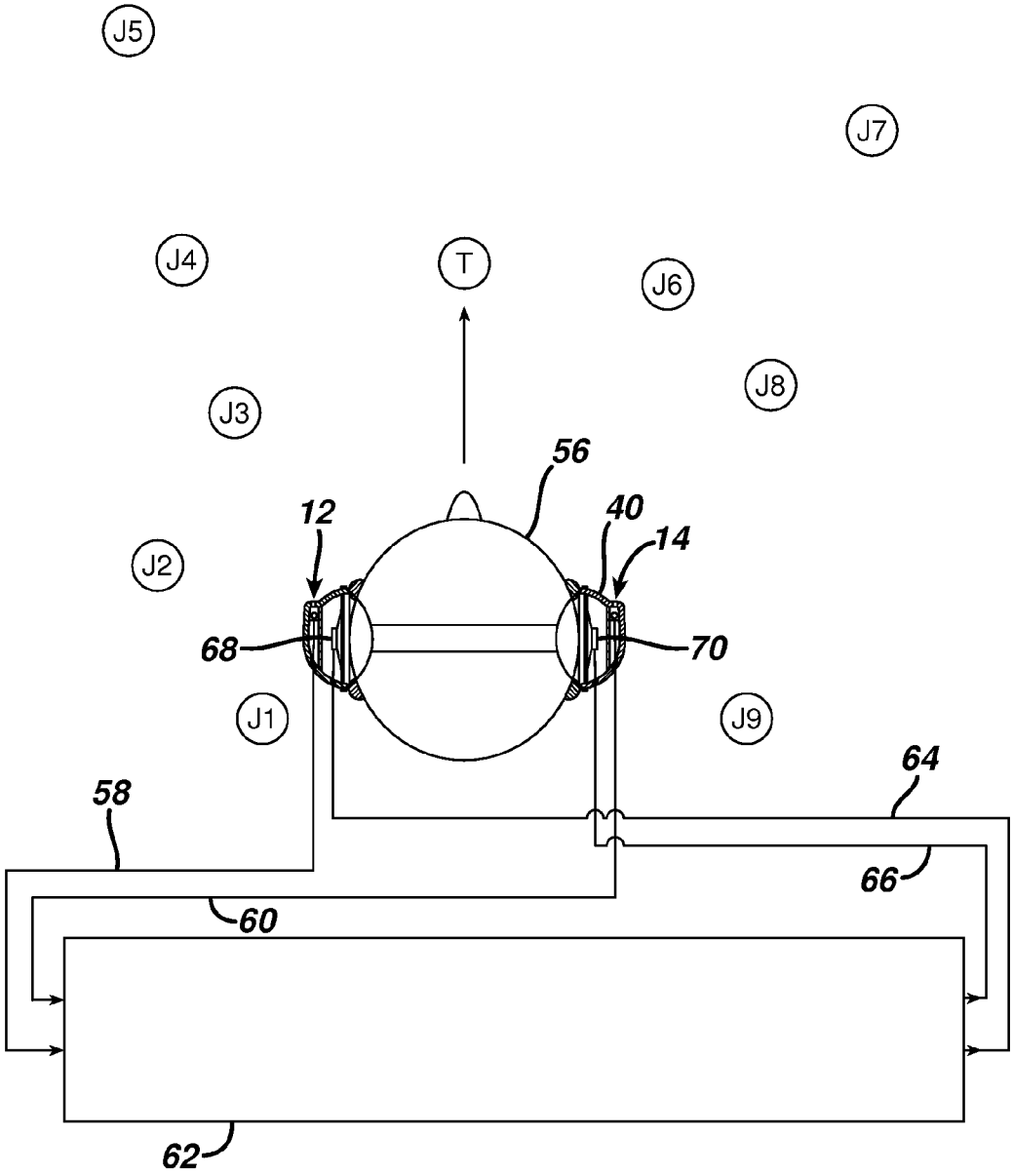
FIG. 2 is a schematic top view of the hearing assistance device of FIG. 1 being worn by a user.

Turning to FIG. 2, the headphones 40 are shown being worn by a person (user) 56. A sound source of interest T is located directly in front of the person 56. Sound source T might be another person with whom person 56 is trying to hold a conversation. Acoustic waves from sound source T will reach the transducers 12 and 14 at approximately the same time and at about the same magnitude because sound source T is about equidistant from transducers 12 and 14. There are also a multiplicity of jammers J1-J9 in the vicinity of the user 56. Jammers J1-J9 are sound sources that are not of interest to the user 56. Examples of jammers are other people holding conversations in the vicinity of person 56 and sound source T, an audio system, a television, construction noise, a fan etc. Acoustic waves from any particular jammer will not reach the transducers 12 and 14 at the same time and at the same magnitude because each of the jammers is not equidistant from transducers 12 and 14, and because the head of person 56 has an effect on the acoustic waves. The time of arrival and magnitude of the acoustic waves reaching the transducers 12 and 14 will be used by the hearing assistance device to distinguish between desired sound source T and jammers J1-J9. A pair of electrically conductive lines 58 and 60 respectively connect the transducers 12 and 14 to a signal processor 62. The signal processor is located within the headphones 40 but is shown outside of the headphones in FIG. 2 to assist in explaining this example of the invention. The signal processor 62 will be explained in more detail below. After signals from the transducers 12 and 14 are processed by the signal processor 62, the processed, amplified signals are passed on a pair of electrically conductive lines 64 and 66 to respective acoustic drivers 68 and 70. The acoustic drivers produce sound to the user's ears. The use of directional microphones is helpful in rejecting acoustic energy from any jammers located behind person 56.

Figure 3:
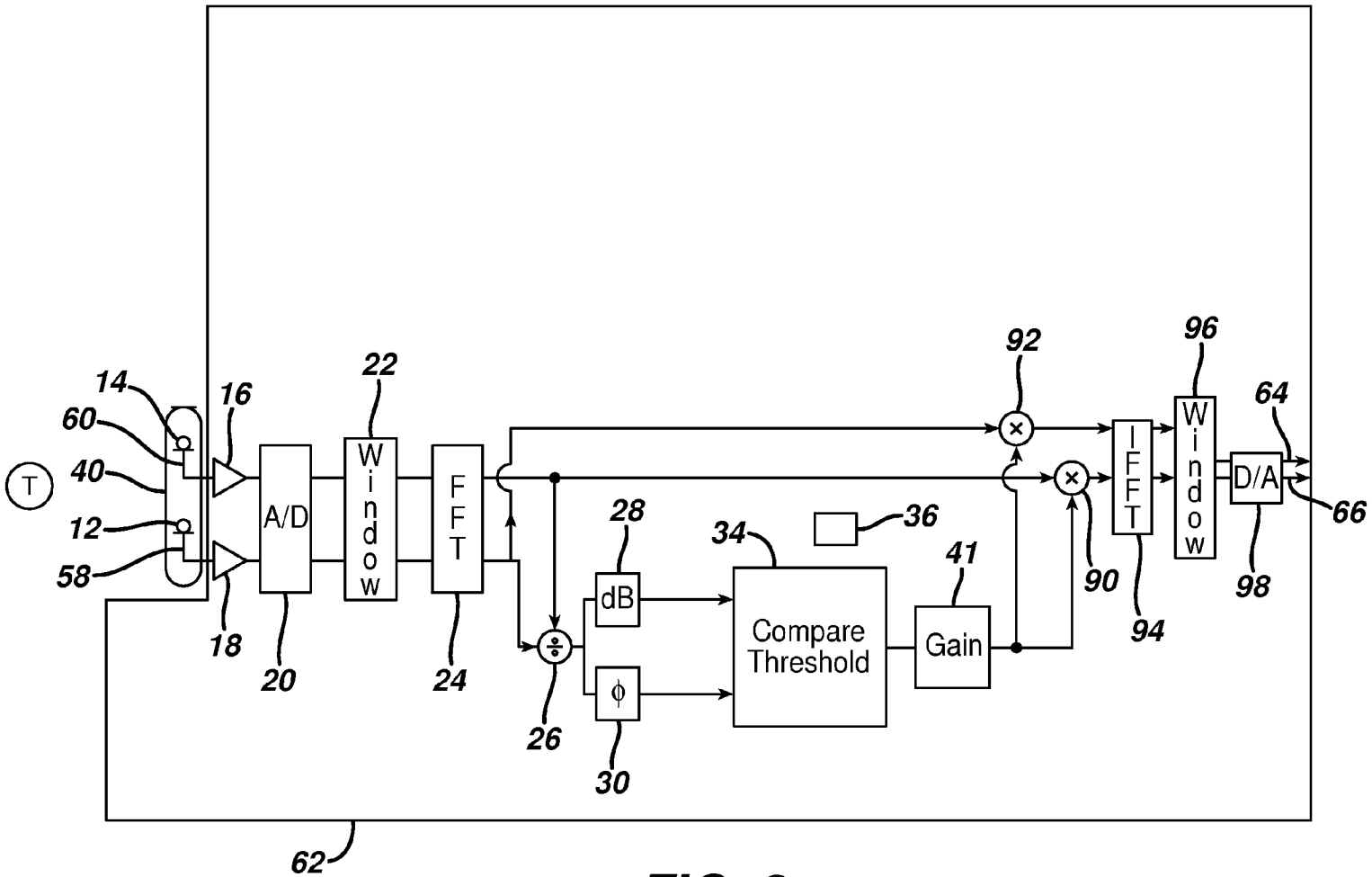
FIG. 3 is a block diagram of a signal processor used in the hearing assistance device of FIG. 1.

With reference to FIG. 3, the signal processor 62 will be described. Acoustic waves from sound sources T and J1-J9 cause transducers 12, 14 to produce electrical signals representing characteristics of the acoustic waves as a function of time. Transducers 12, 14 can connect to the signal processor 62 via a wire or wirelessly. The signals for each transducer pass through respective conventional pre-amplifiers 16 and 18 and a conventional analog-to-digital (A/D) converter 20. In some embodiments, a separate A/D converter is used to convert the signal output by each transducer. Alternatively, a multiplexer can be used with a single A/D converter. Amplifiers 16 and 18 can also provide DC power (i.e. phantom power) to respective transducers 12 and 14 if needed.

Using block processing techniques which are well known to those skilled in the art, blocks of overlapping data are windowed at a block 22 (a separate windowing is done on the signal for each transducer). The windowed data are transformed from the time domain into the frequency domain using a fast Fourier transform (FFT) at a block 24 (a separate FFT is done on the signal for each transducer). This separates the signals into a plurality of linear spaced frequency bands (i.e. bins) for each transducer location. Other types of transforms (e.g. DCT or DFT) can be used to transform the windowed data from the time domain to the frequency domain. For example, a wavelet transform may be used instead of an FFT to obtain log spaced frequency bins. In this embodiment a sampling frequency of 32000 samples/sec is used with each block containing 512 samples.

The definition of the discrete Fourier transform (DFT) and its inverse is as follows:

The functions X=fft(x) and x=ifft(X) implement the transform and inverse transform pair given for vectors of length N by:

$$X(k) = \sum_{j=1}^{N} x(j)\omega_N^{(j-1)(k-1)}$$

$$x(j) = (1/N)\sum_{k=1}^{N} X(k)\omega_N^{-(j-1)(k-1)}$$

where $$\omega_N = e^{(-2\pi i)/N}$$

is an N-th root of unity.

The FFT is an algorithm for implementing the DFT that speeds the computation. The Fourier transform of a real signal (such as audio) yields a complex result. The magnitude of a complex number X is defined as:

$$\sqrt{\mathrm{real}(x)^2+\mathrm{imag}(x)^2}$$

The angle of a complex number X is defined as:

$$\arctan\left(\frac{\mathrm{Im}(X)}{\mathrm{Re}(X)}\right)$$

where the sign of the real and imaginary parts is observed to place the angle in the proper quadrant of the unit circle, allowing a result in the range:

$$-\pi \le \mathrm{angle}(X) < \pi$$

The magnitude ratio of two complex values, X1 and X2 can be calculated in any of a number of ways. One can take the ratio of X1 and X2, and then find the magnitude of the result. Or, one can find the magnitude of X1 and X2 separately, and take their ratio. Alternatively, one can work in log space, and take the log of the magnitude of the ratio, or alternatively, the difference (subtraction) of log(|X1|) and log(|X2|).

As described above, a relationship of the signals is established. In some embodiments the relationship is the ratio of the signal from transducer 12 to the signal from transducer 14 which is calculated for each frequency bin on a block-by-block basis at a divider block 26. The magnitude of this ratio (relationship) in dB is calculated at a block 28.

The calculated magnitude relationship in dB and phase angle in degrees for each frequency bin (band) are used to determine gain at a block 34. A graphical example of how the gain is determined is shown in a graph 70 of FIG. 4. There are a total of five circumscribed lines (gain contours) 81, 83, 85, 87 and 89 in the graph which are similar to contour lines on a topographic map. The graph 70 presents the magnitude difference in dB on a horizontal axis 72 and the phase difference in degrees on a vertical axis 74. For a particular frequency bin, the data point at the intersection of the phase angle difference with the magnitude difference will determine how much gain should be applied to that frequency bin. As an example, a frequency bin with all or most of its acoustic energy coming from sound source "T" would have a magnitude (level) difference between transducers 12 and 14 of about 0 dB and an angle of about 0 degrees. The data point of these two parameters will be at point 76 in graph 70. Because point 76 is in an area 78 of graph 70, that frequency bin will have a gain of 0 db applied to it. Point 76 is representative of a sound source located within a zone in front of the user of the hearing assistance device. The user is facing this sound source which is on axis with the user (e.g. sound source "T" of FIG. 2). It is desired for sound sources located within this zone to be audible to the user.

If a data point of magnitude and angle falls in an area 80 then the corresponding frequency bin will be attenuated by between 0 to −5 dB depending on where the data point falls between lines 81 and 83. If a data point of magnitude and angle falls in an area 82 then the corresponding frequency bin will be attenuated by between 5 dB to 10 dB depending on where the data point falls between lines 83 and 85. If a data point of magnitude and angle falls in an area 84 then the corresponding frequency bin will be attenuated by between 10 dB to 15 dB depending on where the data point falls between lines 85 and 87. If a data point of magnitude and angle falls in an area 86 then the corresponding frequency bin will be attenuated by between 15 dB to 20 dB depending on where the data point falls between lines 87 and 89. Finally, if a data point of magnitude and angle falls in an area 88 (e.g. jammer J7 at 40 degrees) then the corresponding frequency bin will be attenuated by 20 dB. Areas 80-88 are representative of sound sources located outside the zone in front of the user of the hearing assistance device.

The effect of what is described in the previous paragraph is that acoustic energy from a sound source (e.g. "T") directly in front of a person 56 will be passed through to that person's ears unattenuated. As acoustic energy sources (e.g. J1-J9) get progressively more off axis the acoustic energy from those sources is progressively attenuated. This results in the person 56 being able to more clearly hear the talker "T" over and above the jammers J1-J9. In other words, the signal processor 62 provides relatively more emphasis of data representing a first sound source the person is facing over data representing a second sound source the person is not facing.

An alternative to using the phase angle to calculate gain is to use the time delay between when an acoustic wave reaches transducer 12 and when that wave reaches transducer 14. The equivalent time delay is defined as:

$$\frac{\text{angle}(X)}{2\cdot\pi\cdot f}$$

The time delay represented by two complex values can be calculated in a number of ways. One can take the ratio of X1 and X2, find the angle of the result and divide by the angular frequency. One can find the angle of X1 and X2 separately, subtract them, and divide the result by the angular frequency. A time difference (delay) $\tau$ (Tau) is calculated for each frequency bin on a block-by-block basis by first computing the phase at block 30 and then dividing the phase by the center frequency of each frequency bin. The time delay $\tau$ represents the lapsed time between when an acoustic wave is detected by transducer 12 and when this wave is detected by a transducer 14. Other well known digital signal processing (DSP) techniques for estimating magnitude and time delay differences between the two transducer signals may be used. For example, an alternate approach to calculating time delay differences is to use cross correlation in each frequency band between the two signals X1 and X2.

Figure 4:
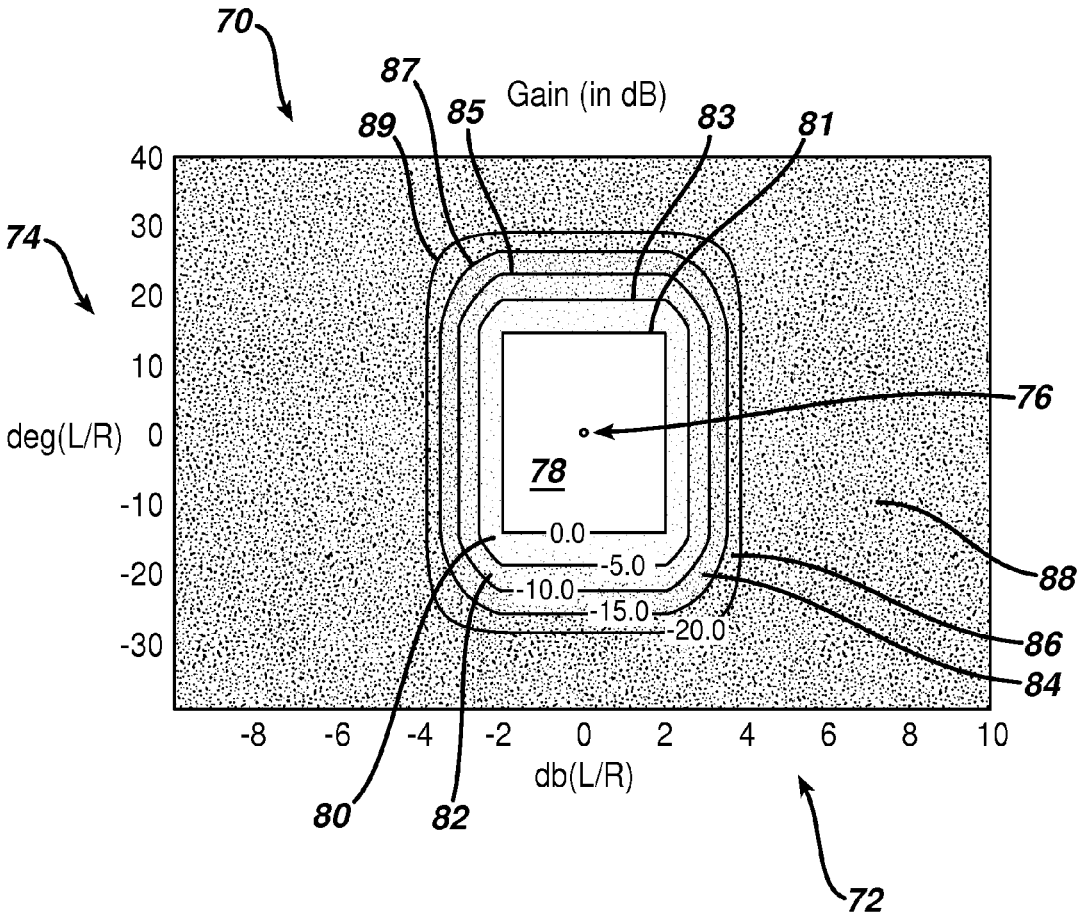
FIG. 4 is a graph of values used to determine gain.

For the case using a time delay, a graph different from that shown in FIG. 4 would be used in which the phase difference in degrees on the vertical axis 74 is replaced with time difference on the vertical axis 74. At 1000 hz a time delay of 0 would equal an angle of 0 degrees between the person 56 and the sound source supplying the energy at 1000 hz. This would reflect that the sound source supplying the energy at 1000 hz is directly in front of. the person 56. At 1000 hz a time delay of (a) 28 microseconds would indicate an angle of about 10 degrees, (b) 56 microseconds would indicate an angle of about 20 degrees, (c) 83 microseconds would indicate an angle of about 30 degrees, and (d) 111 microseconds would indicate an angle of about 40 degrees.

At any instant and in any frequency band, the closer the magnitude and phase are to point 76 (the origin of the plot) of FIG. 4, the more likely that (a) an associated sound source is on axis to the person 56, and (b) the energy in that frequency band at that instant is something the person 56 wants to hear (e.g. speech from sound source "T").

Moving the gain contours 81, 83, 85, 87 and 89 (FIG. 4) further out from origin 76 offers advantages and disadvantages as does moving the gain contours further in towards origin 76. Moving the gain contours 81, 83, 85, 87 and 89 further away from origin 76 (and optionally from each other) allows successively more acoustic energy from competing sound sources (e.g. J1-J8) to pass to the person 56. This results in a sound acceptance window being wider. If the amount of jammer noise is low then it is acceptable to have a wider acceptance window because this will give person 56 a better sense of the acoustic space in which (s) he is located. If the amount of jammer noise is high then having a wider acceptance window makes it more difficult to understand speech from sound source "T".

On the contrary, moving the gain contours 81, 83, 85, 87 and 89 closer to the origin 76 (and optionally to each other) allows successively less acoustic energy from competing sound sources (e.g. J1-J8) to pass to the person 56. If the amount of jammer noise is high then having a narrower acceptance window makes it easier to understand speech from sound source "T". However, if the amount of jammer noise is low then a narrower acceptance window is less desirable because it can cause more false negatives (i.e. sound source T energy is rejected when it should have been accepted). False negatives can occur because noise, competing sound sources (e.g. jammers), and/or room reverberation can alter the magnitude and phase differences between the two microphones. False negatives cause speech from sound source T to sound less natural.

The wide to narrow acceptance window can be set by a user control 36 which can operate over a continuous range or through a small number of presets. It should be noted that contour lines 81, 83, 85, 87 and 89 can be moved closer to or farther from the origin 76 and each other along (a) the magnitude axis 72 alone, (b) the phase axis 74 alone, or (c) along both the magnitude and phase axes 72 and 74. Additionally, the wide to narrow acceptance window need not be the same at every frequency. For example, in typical environments there is both less noise and less speech energy at higher speech frequencies (e.g., at 2 KHz). However, the human ear is very sensitive at these higher speech frequencies, particularly to musical noise which is created by the false acceptance of unwanted acoustic energy. To reduce this effect, the acceptance window can be made wider in certain frequency bands (e.g. 1800-2200 Hz) as compared to other frequency bands. With the wider acceptance window there is a trade-off between reduced rejection of unwanted acoustic energy (e.g. from jammers J1-J9) and reduced musical noise.

The gains are calculated at block 34 (FIG. 3) for each frequency bin in each data block. The calculated gain may be further manipulated in other ways known to those skilled in the art at a block 41 to minimize the artifacts generated by such gain change. For example, the gain in any frequency bin can be allowed to rise quickly but fall more slowly using a fast attack slow decay filter. In another approach, a limit is set on how much the gain is allowed to vary from one frequency bin to the next in any given amount of time. On a frequency bin by frequency bin basis, the calculated gain is applied to the frequency domain signal from each transducer at respective multiplier blocks 90 and 92.

Using conventional block processing techniques, the modified signals are inverse FFT'd at a block 94 to transform the signal from the frequency domain back into the time domain. The signals are then windowed, overlapped and summed with the previous blocks at a block 96. At a block 98 the signals are converted from digital signals back to an analog (output) signals. The signal outputs of block 98 are then each sent to a conventional amplifier (not shown) and respective acoustic drivers 68 and 70 (i.e. speaker) along lines 64 and 66 to produce sound (see FIG. 2).

As an alternative to using a fast attack slow decay filter (discussed two paragraphs above), slew rate limiting can be used in the signal processing in block 41. Slew rate limiting is a non-linear method for smoothing noisy signals. The method prevents the gain control signal (e.g. coming out of block 34 in FIG. 3) from changing too fast, which could cause audible artifacts. For each frequency bin, the gain control signal is not permitted to change by more than a specified value from one block to the next. The value may be different for increasing gain than for decreasing gain. Thus, the gain actually applied to the audio signals (e.g. from transducers 12 and 14) from the output of the slew rate limiter (in block 41) may lag behind the calculated gain output from block 34.

Figure 5:
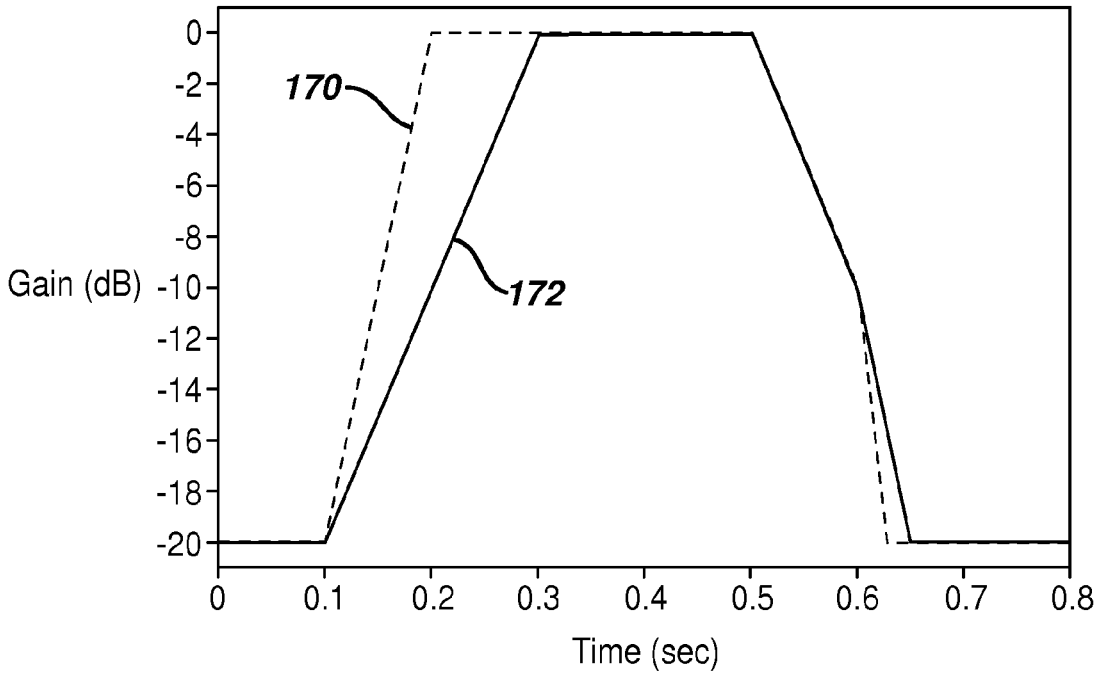
FIG. 5 is a plot of calculated gain and slew rate limited gain verses time for a particular frequency bin.

Referring to FIG. 5, a dotted line 170 shows the calculated gain output from block 34 for a particular frequency bin plotted versus time. A solid line 172 shows the slew rate limited gain output from block 41 that results after slew rate limiting is applied. In this example, the gain is not permitted to rise faster than 100 db/sec, and not permitted to fall faster than 200 dB/sec. Selection of the slew rate is determined by competing factors. The slew rate should be as fast as possible to maximize rejection of undesired acoustic sources. However, to minimize audible artifacts, the slew rate should be as slow as possible. The gain can be slewed down more slowly than up based on psychoacoustic factors without problems.

Thus between t=0.1 and 0.3 seconds, the applied gain (which has been slew rate limited) lags behind the calculated gain because the calculated gain is rising faster than 100 db/sec. Between t=0.5 and 0.6, the calculated and applied gains are the same, since the calculated gain is falling at a rate less than 200 dB/sec. Beyond t=0.6, the calculated gain is falling faster than 200 dB/sec, and the applied gain lags once again until it can catch up.

In at least some prior art hearing assistance devices such as hearing aids, a gain of substantially greater than 1 is used to increase the level of external sounds, making all sounds louder. This approach can be uncomfortable and ineffective because of "recruitment" which occurs with sensorineural hearing loss. Recruitment causes the perception that sounds get too loud too fast. In the example described above, there is substantially unity gain applied to desired sounds, whereas a gain of less than 1 is applied to undesired sounds (e.g. from the jammers). So desired sounds remain at their natural level and undesired sounds are made softer. This approach avoids the problem of recruitment by not making the desired sounds any louder than they would be without the hearing assistance device. Intelligibility of the desired sounds is increased because the level of undesired sounds is reduced.

Figure 6:
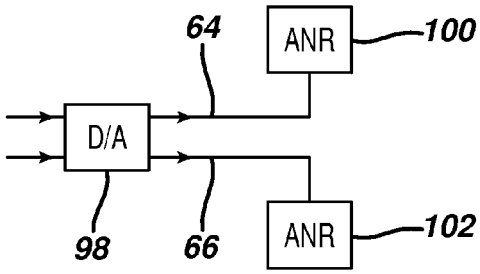
FIG. 6 is an example of a hearing assistance device that includes an active noise reduction system.

Turning to FIG. 6, a further example will be described. Active noise reduction (ANR) systems 100 and 102 have been included in the signal paths after D/A converter 98. ANR systems as contemplated herein can be effective in reducing the amount of ambient noise that reaches a person's ears. ANR systems 100 and 102 will respectively include the acoustic drivers 68 and 70 (FIG. 2). Such ANR systems are disclosed, for example, in U.S. Pat. No. 4,455,675 which is incorporated herein by reference. The signal on line 64 or 66 of the instant application would be applied to input terminal 24 in FIG. 2 of the '675 patent. In the event that the ANR system is digital instead of analog, the D/A converter 98 is eliminated (although the digital ANR signal will need to be converted to an analogue signal at some point). Although the '675 patent discloses a feedback type of ANR system, a feed-forward or a combination feed-forward/feedback type of ANR system may be used instead.

It is desirable in some embodiments to reduce the overall level of environmental sound that reaches the user's ears. This can be done using passive, active, or combinations of active and passive noise attenuation methods. The goal is to first substantially reduce the level of environmental sound presented to the user. Subsequently, desired signals are re-introduced to the user while undesirable sounds remain attenuated through the previously described signal processing. The desired sounds can then be presented to the user at levels representative of their levels in the ambient environment, but with the level of interfering signals substantially reduced.

Another example will now be described in which a voice activity detector (VAD) is used. The VAD can be used in combination with the example described with reference to FIG. 6. The use of a VAD allows accepted speech from a talker T (FIG. 2) to be more natural sounding, and reduces audible artifacts (e.g. musical noise) when no talker is facing the user of the hearing assistance device. The VAD in one example receives the output of gain control block 41 and modifies the gain signals according to the likelihood that speech is present.

VADs are well known to those skilled in the art. A VAD analyzes how stationary an audio signal is and assigns an estimate of voice activity ranging from, for example, zero (no speech present) to one (high likelihood of speech present). In a frequency bin where the acoustic energy level is changing only slightly compared to a long term average, the audio signal is relatively stationary. This condition is more typical of background noise rather than speech. When the energy in a frequency bin changes rapidly relative to a long term average, it is more likely that the audio signal contains speech.

A VAD signal can be determined or created for each frequency bin. Alternatively, VAD signals for each bin can be combined together to create an estimate of the speech presence over the entire audio bandwidth. Another alternative is to sum the acoustic energies in all bands, and compare the changes in the summed energies to a long term average to calculate a single VAD estimate. This summing of acoustic energy may be done over all frequency bands, or only across those bands for which speech energy is likely (e.g. excluding extreme high and low frequencies).

Once a VAD estimate has been calculated, the signal can be used in a number of different ways in the hearing assistance device. The VAD signal can be used to automatically change the acceptance window in the gain stage, moving the contour lines 81, 83, 85, 87 and 89 (FIG. 4) depending on whether or not a talker is present. When no talker is present the acceptance window is widened by expanding the contour lines 81, 83, 85, 87 and 89 away from the origin 76 and/or each other. Likewise, when a talker is present the acceptance window is narrowed by contracting the contour lines (FIG. 4) towards the origin 76 and/or each other. Another way the VAD signal can be used is to adjust how quickly the gain out of block 41 (FIG. 3) is allowed to change from one moment to the next within a frequency bin. For example, when a talker is present the gain is allowed to change more rapidly than when a talker is not present. This results in reducing the amount of musical noise in the processed signal. A still further way the VAD can be used is to assign a gain of 0 or 1 to each frequency bin depending on whether it was likely that no speech was present (gain of 0) verses it being likely that speech is present (gain of 1). Combinations of the above are also possible.

A VAD typically processes an audio signal that has the potential of containing speech. As such, the outputs of block 24 in FIG. 3 can feed into a VAD. Alternatively, the outputs of multipliers 90 and 92 of FIG. 3 can feed into a VAD. In either case, the output of the VAD would feed into (a) block 34 if the VAD signal is being used to control the acceptance window, and/or (b) block 41 if the VAD signal is being used to control how quickly the gain is allowed to change (both described in the previous paragraph).

Figure 7:
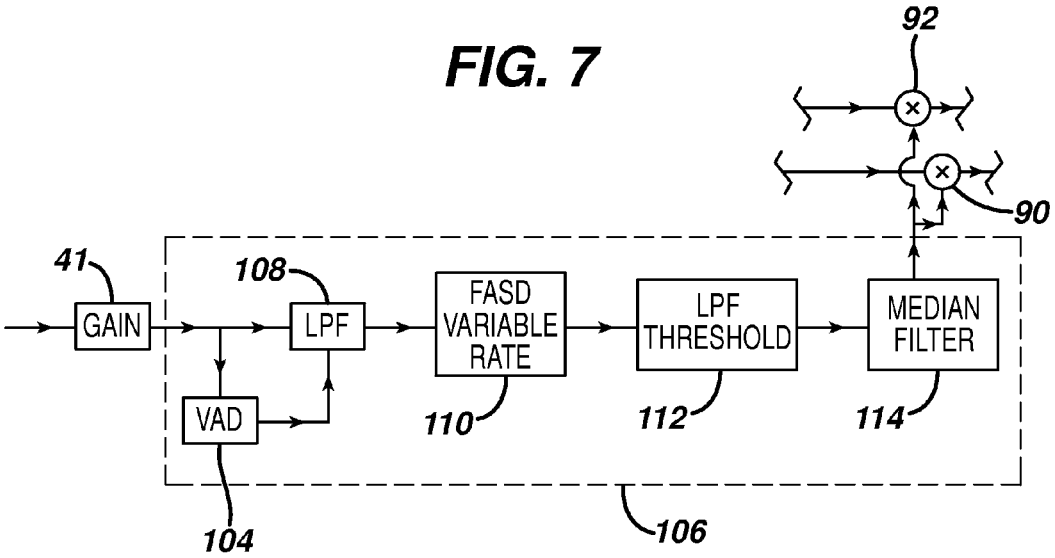
FIG. 7 is an example of a hearing assistance device that includes a voice activity detector.

In FIG. 7 another example is shown in which a VAD 104 receives a signal from the output of gain block 41. This is unusual because the VAD is not receiving an audio signal which may include speech: the VAD is receiving a signal derived from audio signals which may contain speech. The VAD 104 is part of a post-processing block 106.

Figure 8:
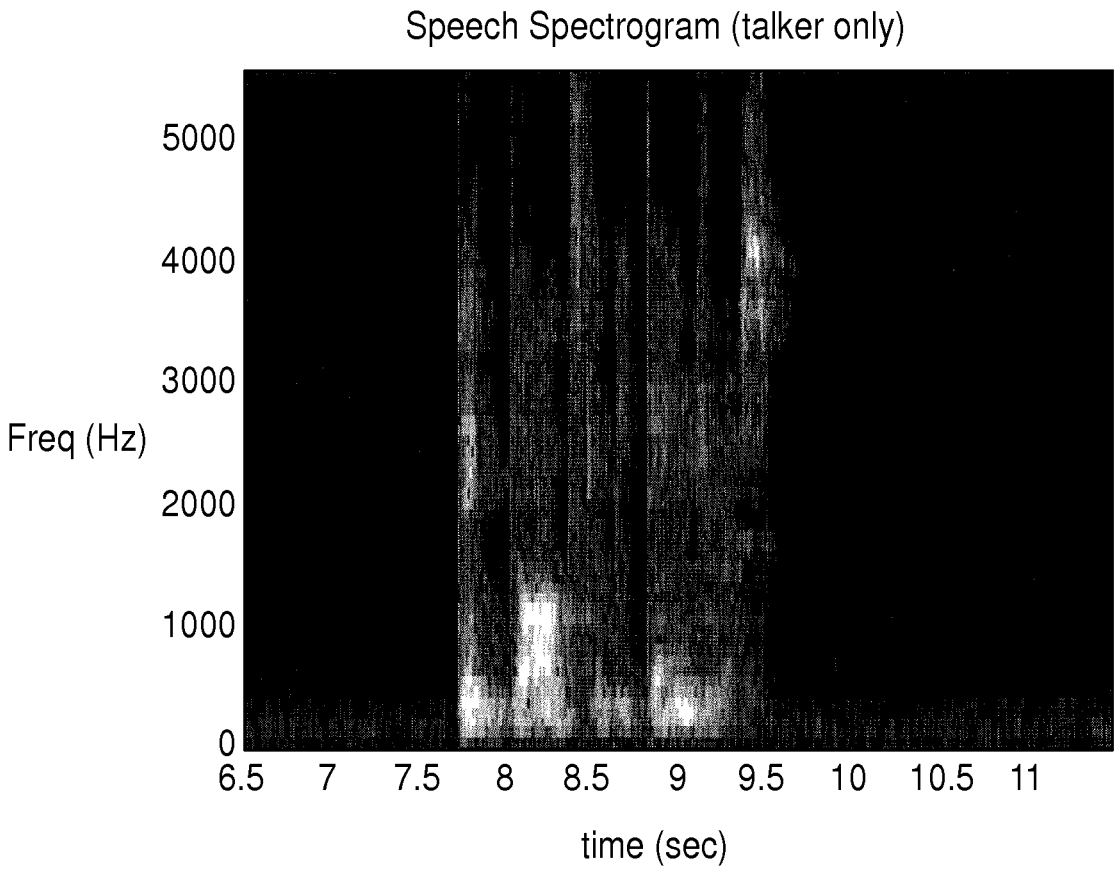
FIG. 8 is a speech spectrogram in which only a single desired talker is present.
Figure 9:
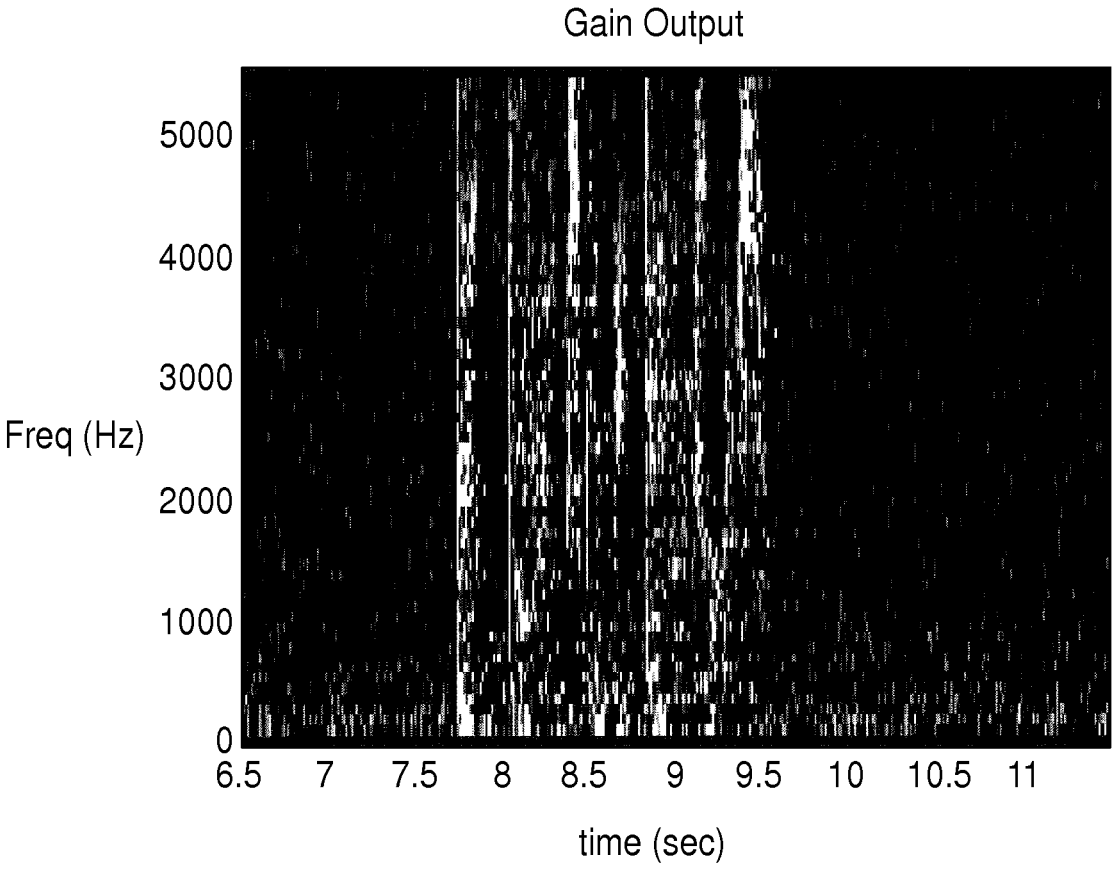
FIG. 9 is the gain output of block 41 (FIG. 7) when only a single desired talker is present.

When there is a talker directly facing a user of the hearing assistance device with no other jammers, the output of gain block 41 (see FIG. 9) has a strong resemblance to a spectrogram of the talker's speech (see FIG. 8). Note that in FIG. 9, when the desired talker is not producing sound, there is still ambient noise, acoustic and/or electric, which does not meet the acceptance criteria. This results in low gain at times and frequencies where there is little or no desired talker acoustic energy. In FIG. 8 a talker has uttered a single sentence in the time between t=7.7 and 9.7 seconds. The x-axis in FIG. 8 shows the time variable and the y-axis shows the frequency variable. The brightness of the plot shows the energy level. So, for example, at about f-1000 hz and t-8.2 sec, the talker has a lot of energy in his speech. In FIG. 9 the x and y axes are the same as in FIG. 8. Brightness of the pot in FIG. 9 indicates the gain. FIGS. 8 and 9 together demonstrate that the degree to which the gain signal out of block 41 is stationary is an excellent measure of stationarity of the speech, and thus the voice activity of a desired talker. This is reflected in the similarity of the speech signal spectrogram in FIG. 8 and the gain signal in FIG. 9. The degree to which the gain signal is stationary depends only on the voice activity of the desired talker, since the gain remains generally low for jammers (undesired talkers) and noise. The VAD of FIG. 7 provides a measure of voice activity only for the desired talker. This is an improvement over prior VAD systems which have some response to off-axis jammers and other noise.

In FIG. 7 a number of filters, both linear and non-linear, are used to process a gain signal out of block 41. The parameters of some of the filters change based on the VAD estimate, while parameters for other filters change based on the input value of the filter in each frequency bin. Each of the filters in block 106 provide an additional benefit, but the greatest benefit comes from a VAD driven low pass filter (LPF) 108. LPF 108 can be used alone or in combination with some or all of the filters which follow it.

A gain signal exiting block 41 feeds both the VAD 104 and the LPF 108. The LPF 108 processes the gain signal and the VAD 104 sets the cutoff frequency of the LPF 108. When the VAD 104 gives a high estimate (indicating a desired talker is likely to be present), the frequency cutoff of the LPF 108 is set to be relatively high. As such, the gain is allowed to change rapidly (still limited by slew rate limiting discussed above. to follow the talker of interest. When the VAD estimate is low (indicating only jammers and ambient noise are present), the frequency cutoff of the LPF 108 is set to be relatively low. Accordingly, gain is constrained to change more slowly. As such, false positives in the gain signal (indicating a desired talker is present when this is not the case) are greatly slowed down and significantly rejected. In summary, a characteristic of the signal processor is adjusted based on whether or not the voice activity detector detects the presence of a human voice.

The modified gain signal out of filter 108 feeds a variable rate fast attack slow decay (FASD) filter 110 whose decay rate depends on a short term average input value to filter 110 in each frequency bin. If the average input value to filter 110 is relatively high, the decay rate is set to be relatively low. Thus, at times and frequencies where a talker has been detected, filter 110 holds the gain high through instances where the gain block 41 has made a false negative error, indicating a desired talker is not present (when this is not the case this would otherwise make the talker less audible). If the average input value to filter 110 is relatively low, as when only jammers and ambient noise are present, the decay rate is set to be relatively high, and the FASD filter 110 decays rapidly.

The output of the FASD filter 110 feeds a threshold dependent low pass filter (LPF) 112. If the input value to filter 112 is above the threshold in any frequency bin, the signal bypasses the low pass filter 112 unmodified. If the input value to filter 112 is at or below the threshold, the gain signal is low pass filtered. This further reduces the effects of false positives in cases where there is no desired talker speaking.

The output of LPF filter 112 feeds a conventional non-linear two-dimensional (or 3×3) median filter 114, which, in every block, replaces the input gain value in each bin with the median gain value of that bin and its 8-neighborhood bins. The median filter 114 further reduces the effects of any false positives when there is no talker of interest in front of the hearing assistance device. The output of median filter 114 is applied to multiplier blocks 90 and 92.

Figure 10:
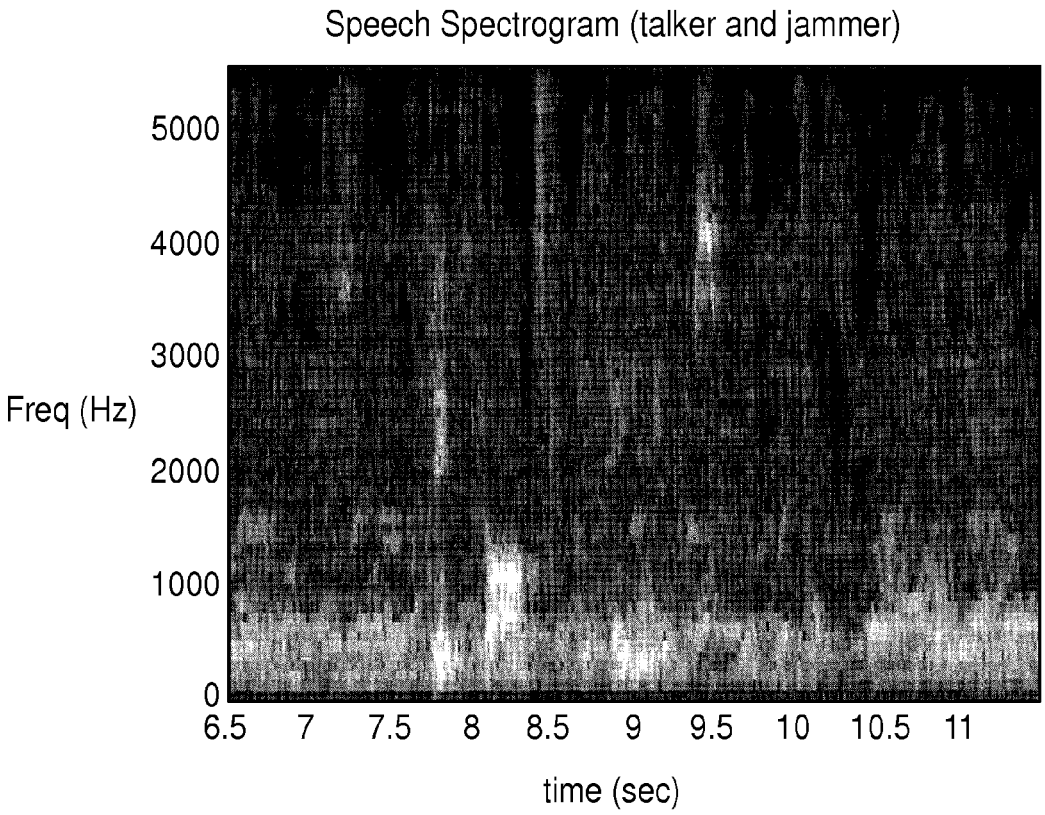
FIG. 10 is a speech spectrogram in which both a desired talker and jammers are present.

The discussion of the remaining figures will indicate the benefit of using a VAD as described above. FIG. 10 shows a speech spectrogram of a microphone signal in which a single on-axis talker (desired talker) is present in a room at the same time as twelve off-axis jammers. The desired talkers speech is the same as in FIG. 8. Because the average energy from all the jammers exceeds the average energy from the talker, it is hard to identify the talker's speech in the spectrogram. Only a few high energy features from the talker's speech stand out (as white portions in the plot).

Figure 11:
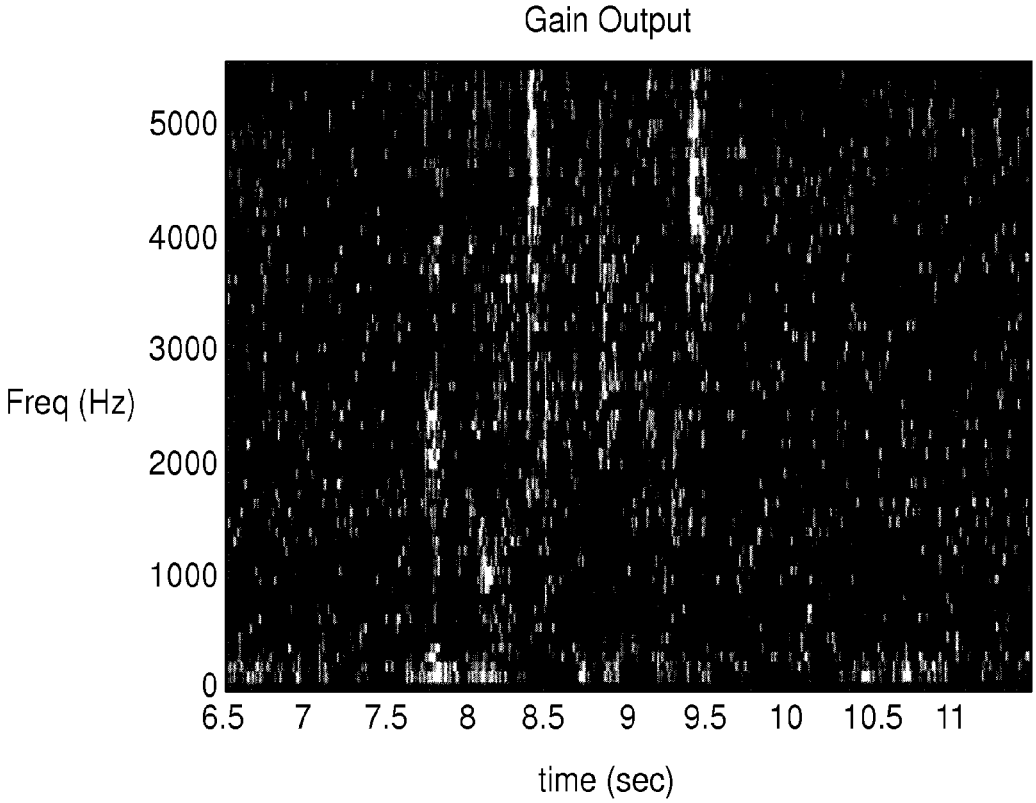
FIG. 11 shows the gain output over time for the situation of FIG. 10.

Turning to FIG. 11, the gain output by block 41 in FIG. 3 for the situation of FIG. 10 is represented. The gain calculation shown in FIG. 11 contains many errors. In regions where there is no desired sound source, there are a number of false positive errors, resulting in high gain (the white marks) where there should be none. In regions where there is a desired sound source, the gain estimator contains a number of false negatives (black areas), resulting in low gain when the gain should be high. Additionally, the random character of the combined jammers signals occasionally results in magnitude and phase differences that cause these signals to be identified as a desired sound source.

Figure 12:
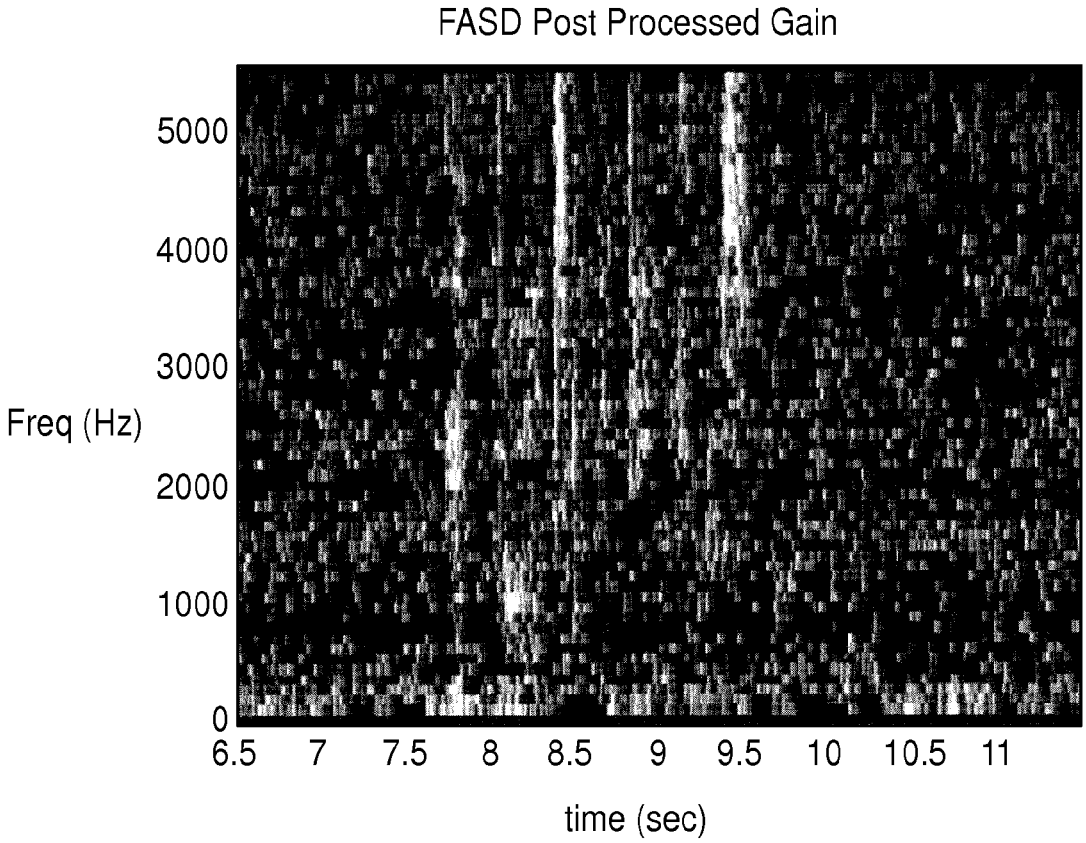
FIG. 12 shows the output of a FASD filter over time.

FIG. 12 shows the results when a basic FASD filter is used to filter the output of gain block 41. FIG. 12 represents the output of the FASD filter. Using the FASD filter reduces the audible artifacts of the errors discussed in the previous paragraph. The false positive errors occurring in the plot when there is no desired talker present remain (e.g. at t=7). The use of the FASD filter makes these errors less obnoxious by reducing the audibility of the musical noise. The false negative errors occurring when a desired talker is present are filled in some by the FASD filter, making these false negative errors less audible.

Figure 13:
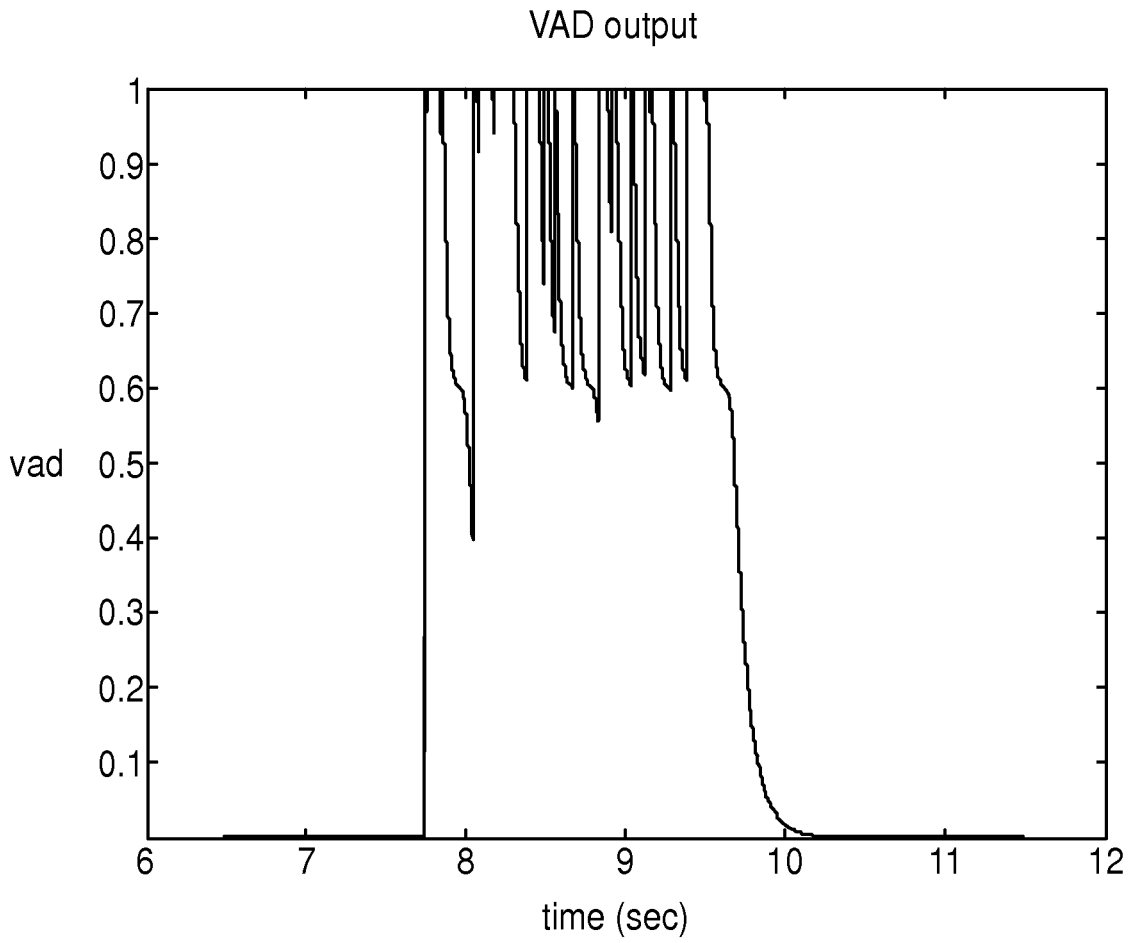
FIG. 13 shows the output of a VAD over time.

FIG. 13 shows a plot of the output of the VAD 104 in FIG. 7 over time. In this example, a single VAD output is generated for all frequencies. The level of the signal output from VAD 104 causes the remainder of the post processing block 106 to change depending on whether desired talker speech is present (between t7.8 and 9.8 seconds) or absent.

Figure 14:
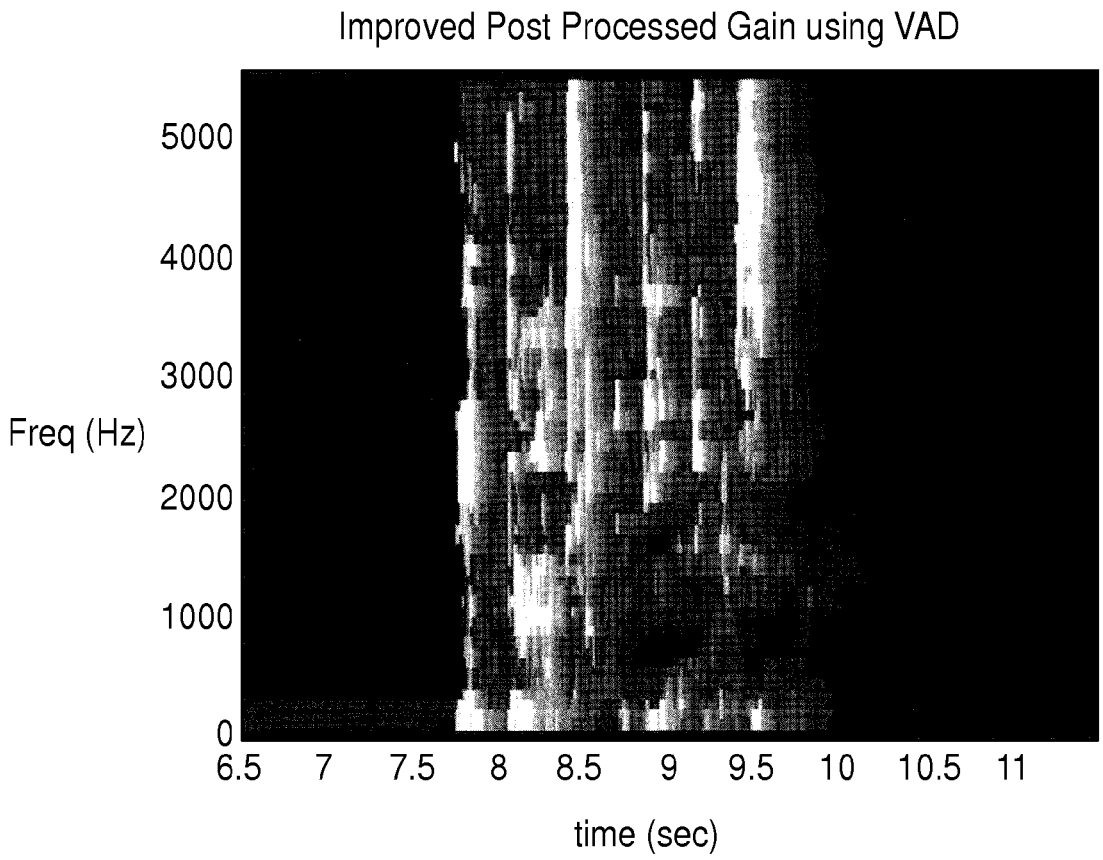
FIG. 14 shows the output of the post processing block 106 of FIG. 7 over time.

FIG. 14 discloses the output of post-processing block 106 of FIG. 7. False positive errors, when there is no desired talker speaking, have been virtually eliminated. As a result, there are few audible artifacts during these periods. The jammers are reduced in level without the introduction of musical noise or other annoying artifacts. False negative errors, when the desired talker is speaking, are also greatly reduced. Accordingly, the reproduced speech of the desired talker is much more natural sounding.

Figure 15:
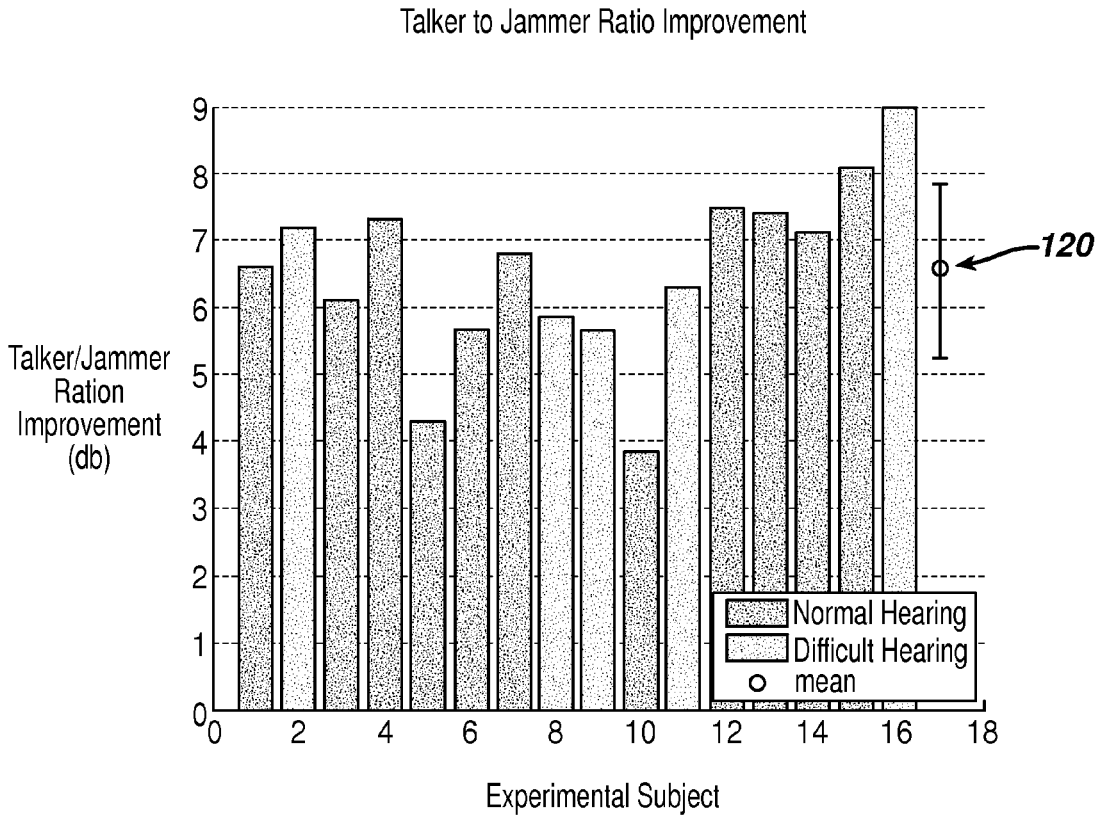
FIGS. 15-16 are graphs which display data representing improvements provided by the hearing assistance device and method.
Figure 16:
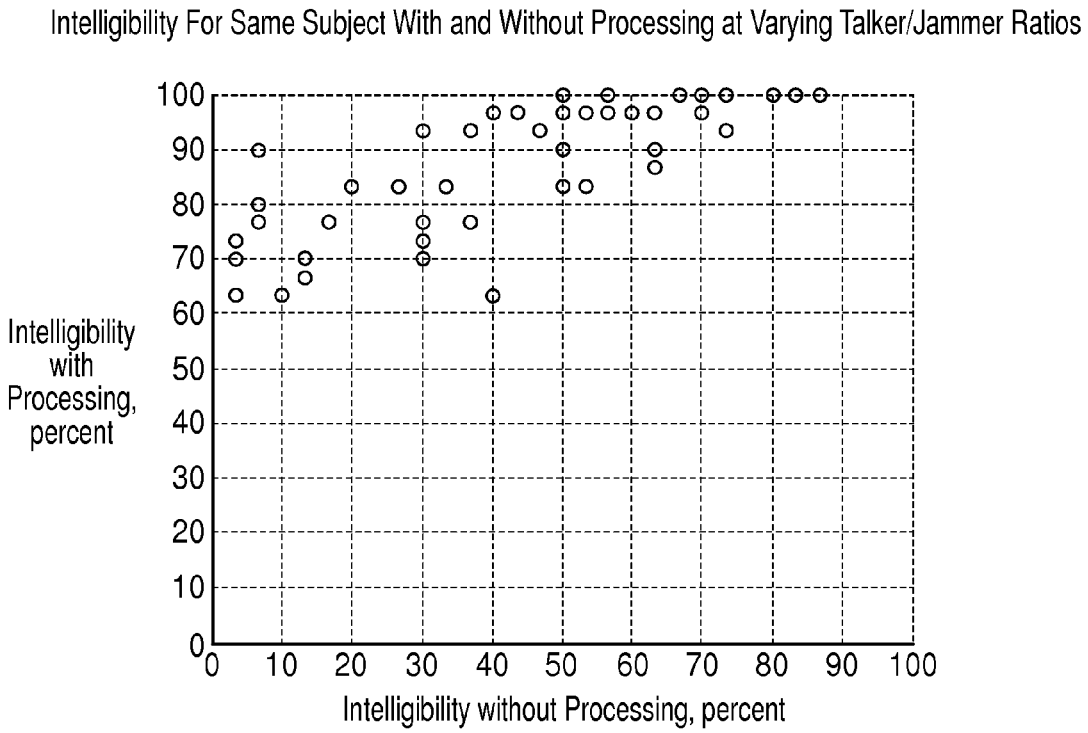

FIGS. 15-16 disclose graphs which display data representing improvements provided by the hearing assistance device and method disclosed herein. Tests were done with dummy head recordings as follows. Recordings of talkers alone and jammers alone were made in a room with a dummy head wearing the headset of FIG. 1. The talkers and jammers spoke standard intelligibility test sentences. Sixteen test subjects, including those with normal hearing and those with hearing impairments, each had the recordings played back to them via the headset of FIG. 1. Note that the voice activity detector, directional microphones and active noise reduction were not used during this test process (omni-directional microphones were used).

In FIG. 15 the data was processed to find the talker to jammer energy ratio that gave the same intelligibility score (on average) for each subject for playback with no signal processing as compared to playback using the signal processing described with reference to FIGS. 3 and 4. As described in the previous paragraph, the average acoustic energy of the talker alone was measured and recorded. Then the average acoustic energy of the jammers alone was measured and recorded. These two recordings could then be mixed to achieve the desired talker to jammer ratio. The talker to jammer ratio improvement in dB which reflects using the hearing assistance device with signal processing verses no signal processing is provided on the vertical axis. A substantial 6.5 dB average talker to jammer ratio improvement 120 was realized by using the hearing assistance device.

In FIG. 16 each subject was tested on intelligibility with no signal processing, and then again with signal processing (described above with reference to FIGS. 3 and 4) for several talker to jammer energy ratios. The intelligibility scores are plotted. A graph is disclosed that shows intelligibility without signal processing on the horizontal axis and intelligibility with signal processing (as shown and described with reference to FIGS. 3 and 4) on the vertical axis. Each run for each subject is a separate data point. A large improvement in intelligibility is shown. For example, a point 122 shows an intelligibility of about 7% without the signal processing and an intelligibility of about 90% with the signal processing.

With respect to FIG. 3 there is a discussion above of using the user control 36 to manually adjust an acceptance window between wide and narrow settings. This adjustment can also be made automatically. For example, high levels of ambient noise (e.g. from jammers J1-J9), or equivalently, high amounts of active noise reduction suggest that the person 56 is in an acoustic environment with many jammers. In these types of environments, the acceptance window can be narrowed by automatically moving the contour lines 81, 83, 85, 87 and 89 (FIG. 4) closer to the origin 76 and/or to each other. As such, the signal processor is adjusted as a function of an amount of ANR. In this case speech from desired sound source "T" (FIG. 2) might sound less natural to person 56, but the speech/noise from jammers J1-J9 will remain well attenuated.

While the invention has been particularly shown and described with reference to specific exemplary embodiments, it is evident that those skilled in the art may now make numerous modifications of, departures from and uses of the specific apparatus and techniques herein disclosed. Consequently, the invention is to be construed as embracing each and every novel feature and novel combination of features presented in or possessed by the apparatus and techniques herein disclosed and limited only by the spirit and scope of the appended claims.

What is claimed is:

1. A hearing assistance device, comprising:

two transducers which react to a characteristic of an acoustic wave to capture data representative of the characteristic, the device being arranged so that each transducers is located adjacent a respective ear of a person wearing the device;

a signal processor for processing said data to provide relatively more emphasis of data representing a first sound source the person is facing over data representing a second sound source the person is not facing;

at least one speaker which utilizes the data to reproduce sounds to the person; and an active noise reduction system that provides a signal to the speaker for reducing an amount of ambient acoustic noise in the vicinity of the person that is heard by the person, wherein each transducer is selected from the group consisting of:

a first order pressure gradient directional transducer, a higher than first order pressure gradient directional transducer, a combination pressure and first order pressure gradient directional transducer, and a combination pressure and higher than first order pressure gradient directional transducer.

2. The hearing assistance device of claim 1, further comprising:

a voice activity detector, wherein the output of the voice activity detector is used to alter a characteristic of the signal processor.

3. The hearing assistance device of claim 2, wherein the characteristic of the signal processor is altered based on a likelihood that the voice activity detector has detected a human voice in the first sound source.

4. The hearing assistance device of claim 1, wherein the signal processor determines (a) which data represents one or more sound sources located within a zone in front of the user, and (b) which data represents one or more sound sources located outside of the zone, the signal processor being adjustable as a function of at least one of frequency, a user setting, an amount of active noise reduction, a ratio of acoustic energy from sound sources in the zone to sound sources outside the zone, and sound level in a vicinity of the transducers, in order to adjust a size of the zone.

5. The hearing assistance device of claim 1, wherein a gain of substantially 1 is applied to data representing the first sound source, and a gain of substantially less than 1 is applied to data representing the second sound source.

6. A hearing assistance device, comprising:

two transducers, spaced from each other, which react to a characteristic of an acoustic wave to capture data representative of the characteristic;

a signal processor for processing said data to determine based on an acceptance criteria (a) which data represents one or more sound sources located within a zone in front of the user, and (b) which data represents one or more sound sources located outside of the zone, the signal processor providing relatively less emphasis of data representing the sound source(s) outside the zone over data representing the sound source(s) inside the zone;

a voice activity detector for providing an estimate signal representative of the likelihood a speech signal is present within the zone, wherein the acceptance criteria associated with the signal processor is altered based on the estimate signal; and at least one speaker which utilizes the data to reproduce sounds to the user.

7. The hearing assistance device of claim 6, further comprising:

an active noise reduction system that provides a signal to the speaker for reducing an amount of ambient acoustic noise in the vicinity of the user that is heard by the user.

8. The hearing assistance device of claim 6, wherein the signal processor is adjustable as a function of at least one of frequency, a user setting, an amount of active noise reduction, a ratio of acoustic energy from sound sources in the zone to sound sources outside the zone, and sound level in a vicinity of the transducers, in order to adjust an effective size of the zone.

9. The hearing assistance device of claim 6, wherein the signal processor is adjustable in order to adjust an effective size of the zone.

10. The hearing assistance device of claim 9, wherein the signal processor is manually adjustable.

11. The hearing assistance device of claim 9, wherein the signal processor is automatically adjustable as a function of at least one of frequency, a user setting, an amount of active noise reduction, a ratio of acoustic energy from sound sources in the zone to sound sources outside the zone, and sound level in a vicinity of the transducers.

12. The hearing assistance device of claim 6, wherein each transducer is a directional transducer.

* * * * *